US009050811B2

(12) United States Patent
Park

(10) Patent No.: US 9,050,811 B2
(45) Date of Patent: Jun. 9, 2015

(54) IMAGE FORMING APPARATUS

(71) Applicant: Soyoung Park, Kanagawa (JP)

(72) Inventor: Soyoung Park, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 13/738,274

(22) Filed: Jan. 10, 2013

(65) Prior Publication Data

US 2013/0182036 A1 Jul. 18, 2013

(30) Foreign Application Priority Data

Jan. 16, 2012 (JP) ..... 2012-006229

(51) Int. Cl.
*B41J 2/165* (2006.01)

(52) U.S. Cl.
CPC ..... *B41J 2/16538* (2013.01); *B41J 2/16508* (2013.01)

(58) Field of Classification Search
CPC ..... B41J 2/16538; B41J 2/16523; B41J 2/16535; B41J 2/16532
See application file for complete search history.

(56) References Cited

U.S. PATENT DOCUMENTS

| | | | | |
|---|---|---|---|---|
| 5,552,811 | A | 9/1996 | Kurata et al. | |
| 5,608,432 | A | 3/1997 | Yamaguchi | |
| 6,010,203 | A * | 1/2000 | Muraki | 347/30 |
| 7,104,628 | B2 * | 9/2006 | Yamazaki et al. | 347/29 |
| 2002/0036671 | A1 * | 3/2002 | Takahashi et al. | 347/29 |
| 2007/0171252 | A1 * | 7/2007 | Yamamoto | 347/29 |
| 2010/0026758 | A1 * | 2/2010 | Tanaka et al. | 347/37 |
| 2011/0134186 | A1 * | 6/2011 | Shimazaki | 347/33 |
| 2012/0056932 | A1 | 3/2012 | Matsubara et al. | |
| 2012/0056933 | A1 | 3/2012 | Tanaka et al. | |
| 2012/0133706 | A1 | 5/2012 | Park | |
| 2012/0133707 | A1 | 5/2012 | Kikkawa et al. | |
| 2012/0224000 | A1 | 9/2012 | Park | |
| 2012/0224001 | A1 | 9/2012 | Park | |
| 2012/0320125 | A1 | 12/2012 | Katoh et al. | |

FOREIGN PATENT DOCUMENTS

| | | |
|---|---|---|
| JP | 2-1585654 | 6/1990 |
| JP | 6-79880 | 3/1994 |
| JP | 7-132615 | 5/1995 |
| JP | 9-254401 | 9/1997 |
| JP | 10-217441 | 8/1998 |
| JP | 11-268286 | 10/1999 |
| JP | 4186557 | 11/2008 |
| JP | 2012-179814 | 9/2012 |

* cited by examiner

*Primary Examiner* — Manish S Shah
*Assistant Examiner* — Jeremy Delozier
(74) *Attorney, Agent, or Firm* — Cooper & Dunham LLP

(57) ABSTRACT

An image forming apparatus includes a recording head having a nozzle surface including plural nozzles configured to eject liquid droplets, a suction cap configured to seal the nozzle surface of the recording head, a cap holder configured to displaceably hold the suction cap via an elastic member and retractably disposed corresponding to the recording head, and a wiping member configured to wipe the nozzle surface of the recording head in a direction from an upper side to a lower side. The cap holder is provided with a guide part configured to come into contact with an upper end surface of the recording head to frictionally move on the upper end surface of the recording head, and the guide part is disposed on an upper side of the recording head.

6 Claims, 10 Drawing Sheets

IMAGE FORMING APPARATUS

BACKGROUND OF THE INVENTION

1. Field of the Invention

The disclosures herein generally relate to an image forming apparatus, and specifically to an image forming apparatus having a recording head for ejecting ink droplets.

2. Description of the Related Art

An inkjet recording apparatus is generally known as an example of a liquid-jet recording image forming apparatus having, for example, a recording head for ejecting ink droplets, such as a printer, a facsimile machine, or a plotter, or a multifunctional peripheral having a combination of these functions.

Such a liquid-jet recording image forming apparatus includes a maintenance-restoration mechanism composed of a cap for capping a nozzle surface of the recording head, a wiper member (may also called "wiper blade", "wiping blade", or "blade") serving as wiping material for wiping the nozzle surface of the recording head to be cleaned, and the like. The maintenance-restoration mechanism is configured to maintain ejecting stability of nozzles of the recording head, prevent ink inside the nozzles from drying, and prevent dirt or dust from entering into the nozzles. For example, the maintenance-restoration mechanism may perform a restoration operation to form a nozzle meniscus by discharging thickened ink from the nozzles into the cap, and then wiping the nozzle surface with the wiper member.

As an example of a related-art maintenance-restoration mechanism, Japanese Patent No. 4186557 (Patent Document 1) discloses a maintenance-restoration mechanism that includes a cap for capping a nozzle surface of a recording head disposed in a vertical direction, an air release opening formed in an upper end part of the cap, and a suction cap having a suction port disposed at a lower part of the cap.

RELATED ART DOCUMENT

Patent Document

Patent Document 1: Japanese Patent No. 4186557

Patent Document 2: Japanese Laid-open Patent Publication No. 9-254401

In general, a cap holder includes a head guide part disposed such that the head guide part comes into contact with an outer peripheral part of the recording head. The head guide is provided for regulating a cap position corresponding to the recording head.

When the nozzle surface is capped by vertically disposing the nozzle surface of the recording head, and moving the cap in a horizontal direction, a suction operation is conducted in the order of capping, suctioning the head, air releasing from the cap, and de-capping, and then a wiping operation is performed with a wiper member along a nozzle disposed direction from an upper part of the nozzle surface to a lower part of the nozzle surface in order to prevent liquid from dripping.

However, even if a suction unit suctions a waste liquid discharged in the cap, the waste liquid remains in the cap. Hence, when the cap is decapped in that condition, the waste liquid drips from the lower part of the cap and is attached to the head guide part of the cap holder, thereby sticking the dripped waste liquid to the head guide part of the cap holder.

Further, since the waste liquid also remains on the nozzle surface due to the surface tension and viscosity of the waste liquid, in the vertically disposed head, a remaining waste liquid is transferred to a lower side of the head due to gravity, and the remaining waste liquid is also attached to the head guide part of the cap holder and sticks to the head guide part of the cap holder in an end part where the blade-shaped wiper member is detached from the nozzle surface while wiping the nozzle surface in a vertical direction (wiping from the upper part to the lower part of the nozzle surface).

Thus, when the waste liquid is attached to and sticks to the head holder at a lower side of the cap holder, the cap position is shifted from a target position due to the stuck waste liquid. Hence, an airtight sealing condition of the nozzle surface is incomplete, thereby causing dryness of the nozzles, or an increase in viscosity of the liquid, and lowering the suction performance for restoring the nozzles.

SUMMARY OF THE INVENTION

It is a general object of at least one embodiment of the present invention to provide an image forming apparatus having a recording head with a nozzle surface disposed in a vertical direction and capable of preventing a remaining waste liquid from adhering to a cap holder, which substantially eliminate one or more problems caused by the limitations and disadvantages of the related art.

According to an embodiment, there is provided an image forming apparatus that includes a recording head having a nozzle surface including a plurality of nozzles configured to eject liquid droplets;

a suction cap configured to seal the nozzle surface of the recording head; a cap holder configured to displaceably hold the suction cap via an elastic member and be retractably disposed corresponding to the recording head; and a wiping member configured to wipe the nozzle surface of the recording head in a direction from an upper side to a lower side. In the image forming apparatus, the cap holder is provided with a guide part configured to come into contact with an upper end surface of the recording head to frictionally move on the upper end surface of the recording head, and the guide part is disposed on an upper side of the recording head.

Additional objects and advantages of the embodiments will be set forth in part in the description which follows, and in part will be obvious from the description, or may be learned by practice the invention.

It is to be understood that both the foregoing general description and the following detailed description are exemplary and explanatory only and are not restrictive of the invention as claimed.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

A detailed description is given of an ink-jet recording device serving as an image forming apparatus to which preferred embodiments are applied with reference to the accompanying drawings.

Figure 1:
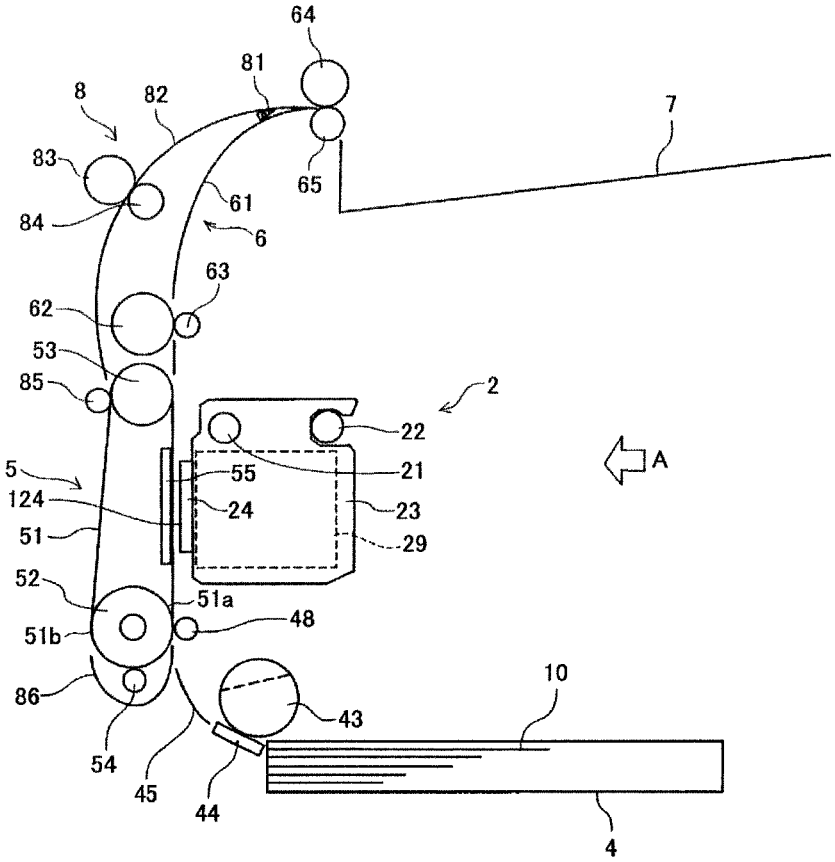
FIG. 1 is a side diagram illustrating a mechanical part of an image forming apparatus according to an embodiment.
Figure 2:
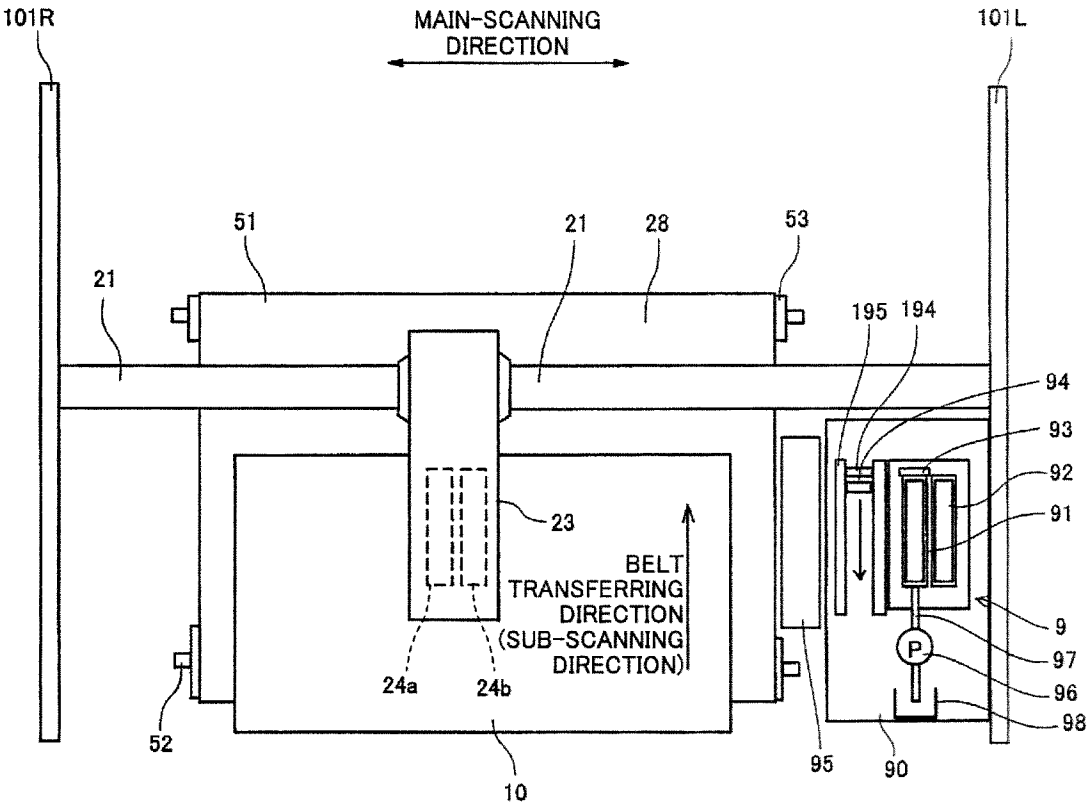
FIG. 2 is a diagram illustrating the mechanical part of the image forming apparatus viewed in an arrow A direction of FIG. 1.

In the following, preferred embodiments of the present invention will be described with reference to the accompanying drawings. First, an image forming apparatus according to an embodiment is described with reference to FIGS. 1 and 2. Note that FIG. 1 is a side diagram of a mechanical part of the image forming apparatus and FIG. 2 is a diagram illustrating the mechanical part viewed in an arrow A direction of FIG. 1;

The image forming apparatus according to the embodiment is a serial-type image forming apparatus. The image forming apparatus includes an image forming part 2, a transferring mechanical part 5, a sheet-feeding tray 4 (serving as a sheet-feeding part and including a sheet-feeding cassette) disposed at a lower side of the image forming apparatus where sheets 10 are stacked. Each of the sheets 10 is acquired from the sheet-feeding tray 4, the image forming part 2 records a desired image on the sheet 10 by ejecting liquid droplets in a horizontal direction while the acquired sheet 10 is intermittently transferred in a vertical direction (perpendicular direction) by the transferring mechanical part 5. Having recorded the desired image on the sheet 10, the sheet 10 is further transferred in an upper direction via a sheet-discharging part 6 so that the sheet 10 is discharged onto a sheet-receiving tray 7 provided on an upper side of a main body of the image forming apparatus (herein after also called "an apparatus main body").

Further, in duplex printing, after an image is printed on one surface of the sheet 10, the sheet 10 is moved from the sheet-discharging part 6 into an inverting part 8 so that the sheet 10 is transferred in an inverse direction (i.e., a downward direction) by the transferring mechanical part 5. The inverted sheet 10 having now the other surface (i.e., a rear surface) as a printable surface is then transferred in the transferring mechanical part 5 again, so that an image is printed on the other surface (i.e., the rear surface). Having printed a desired image on the rear surface of the sheet 10, the sheet is then discharged onto the sheet-receiving tray 7.

Note that the image forming part 2 is configured to slidably hold a carriage 23 having a recording head 24 with a main-guide member 21 and a sub-guide member 22 that bridge between a left side plate 101L and a right side plate 101R, so that the image forming part 2 moves and scans in a main-scanning direction via a timing belt looped over a driving pulley and a driven pulley driven by a main-scanning motor serving as a not-illustrated carriage moving mechanism.

The carriage 23 includes two recording heads 24*a* and 24*b* (may be integrally called "a recording head 24") having liquid-jet heads for ejecting ink droplets of respective colors of yellow (Y), cyan (C), magenta (M), and black (K). The recording heads 24*a* and 24*b* include nozzle arrays composed of plural nozzles disposed in a sub-scanning direction orthogonal to the main-scanning direction, and the ink droplet ejecting directions of the nozzles are directed in a horizontal direction. That is, the image forming apparatus according to the embodiment employs a horizontal ejection type having a recording head 24 in which a nozzle surface having the nozzles ejecting liquid droplets is disposed in a vertical direction and the nozzles are configured to eject liquid droplets in a horizontal direction.

Each of the recording heads 24*a* and 24*b* has two nozzle arrays having nozzles for discharging liquid-droplets of different colors disposed in array. The recording head 24*a* includes a first nozzle array configured to eject yellow (Y) liquid-droplets and a second nozzle array configured to eject magenta (M) liquid-droplets. The recording head 24*b* includes a first nozzle array configured to eject black (K) liquid-droplets and a second nozzle array configured to eject cyan (C) liquid-droplets.

The carriage 23 includes a head tank 29 for supplying ink of different colors corresponding to the nozzle arrays of the recording heads 24*a* and 24*b*. Ink is supplied to the ink tank 29 from ink cartridges (main-tanks) of different colors detachably attached to the apparatus main body.

Each of the sheets 10 stacked on the sheet-feeding tray 4 is separated from the others by a semicircular sheet-feeding roll (or semicircular roll) 43 and a separation pad 44, and is fed along the transfer guide member 45 and then into the apparatus main body. The sheet 10 fed in the apparatus main body is then transferred between a transfer belt 51 of the transferring mechanical part 5 and a presser roll 48, where the sheet 10 is attracted and transferred by the transfer belt 51.

The transferring mechanical part 5 includes the endless transfer belt 51 looped over a transfer roller serving as a driving roller and a driven roller 53, a charging roller 54 configured to electrostatically charge the transfer belt 51, and a platen member 55 configured to maintain planarity of the transfer belt 51 at a part (position) facing the image forming part 2. Note that the transfer belt 51 peripherally travels in a belt transferring direction (i.e., the sub-scanning direction, or a sheet-transferring direction) driven by the transfer roller 52 that is rotationally driven by a sub-scanning motor of a not-illustrated sub-scanning drive mechanism via a timing belt and a timing pulley.

The sheet-discharging part 66 includes a sheet-discharge guide member 61, a combination of a discharging sheet transfer roller 62 and a spur 63, and a combination of a sheet-discharging roller 64 and a spur 65. In this configuration, the sheet 10 on which the image is formed is discharged from a nip between the sheet-discharging roller 64 and the spur 65 onto the sheet-receiving tray 7 with a surface of the sheet 10 being face-down.

Further, in order to invert a part of the sheet 10 discharged onto the sheet-receiving tray 7 to be transferred into a nip between the transfer belt 51 and a presser roll 48, the inverting part 8 includes a switching claw 81 configured to switch a sheet-discharging path into a sheet-inverting path, an inverting guide member 82, a combination of an inverting roller 83 and a spur 84 serving as an inverting roll, a transferring-assistant roller 85 facing the driven roller 53, a reverse transferring part 51*b* of the transfer belt 51, and a bypass guide member 86 configured to guide the sheet 10 separated from the reverse transferring part 51*b* of the transfer belt 51 into a nip between the transfer belt 51 and the presser 48 by moving the charging roller 54.

Further, a maintenance-restoration mechanism 9 for maintaining and restoring conditions of nozzles 120 of the recording head 24 is disposed in a non-printing area on one side of the scanning direction of the carriage 23.

A frame 90 of the maintenance-restoration mechanism 9 includes a suction cap 91 for capping each of nozzle surfaces 124 (see FIG. 1) of the recording head 24 and a moistening cap 92, and further includes a wiper member (wiper blade) 94 configured to wipe the nozzle surface 124.

The suction cap 91 is held by a cap holder 93; however, a detailed description of a configuration of the suction cap 91 and the cap holder 93 is illustrated later. The suction cap 91 is connected with a suction-discharge path 97 having a suction pump 96 serving as a suction unit, and the suction-discharge path 97 is in communication with a waste liquid tank 98.

The wiper member 94 is held by a wiper holder 194. The wiper holder 194 has projections formed one on each side in the main-scanning direction, and the projections are fit in guide grooves of a wiping guide 195 disposed in the sub-scanning direction. Hence, the wiper member 94 is configured to move in a vertical direction (i.e., the nozzle array direction of the recording head) so as to wipe the nozzle surface 124 of the recording head 24 in a direction from the top to the bottom of the nozzle surface 124 (in a direction indicated by an arrow in FIG. 8).

Further, a non-printing liquid droplet receiver 95 is disposed for receiving liquid droplets of the ink having increased viscosity, which is not usable for printing and thus discharged from the nozzles as a preliminary discharge (non-printing liquid discharge).

Note that the frame 90 of the maintenance-restoration mechanism 9 includes a not-illustrated capping mechanism stepping motor. When the capping mechanism stepping motor rotates in a normal direction, a capping operation is performed by the cap holder 93 and the suction cap 91, while a de-capping operation is performed by the moistening cap 92 via not-illustrated gears and cams. Further, the suction pump 96 is driven by rotating the capping mechanism stepping motor in a reverse direction.

Further, a wiper driving stepping motor is disposed for driving a pinion engaged with a rack disposed on the wiper holder 194, such that the wiper member 94 is moved in a vertical direction by driving the wiper driving stepping motor in a normal direction and in a reverse direction.

In the image forming apparatus having the above configuration, each of the sheets 10 is separately fed from the sheet-feeding tray 4, the fed sheet 10 is electrostatically attracted by the charged transfer belt 51, and the sheet 10 attracted by the transfer belt 51 is transferred in a vertical direction while the transfer belt 51 circulates in peripheral directions. Then, the recording head 24 is driven based on image signals while the carriage 23 is moved so that the recording head 24 discharges ink droplets on the temporarily stopped sheet 10 to thereby record one line of an image. Then, the sheet 10 is transferred a predetermined distant to record a subsequent line. When the recording is completed after repeatedly recording one line at a time of the image, the recorded sheet 10 is discharged onto the sheet-receiving tray 7.

Then, the carriage 23 is moved to a home position that faces a position of the maintenance-restoration mechanism 9 to carry out a maintenance-restoration operation of the nozzles 120 of the recording head 24. The maintenance-restoration operation may include nozzle suctioning to suction the ink inside the nozzles 120 after the corresponding nozzle surface 124 is capped with the suction cap 91, and a non-printing liquid discharge to eject or discharge ink that is not used for forming an image. As a result of conducting such maintenance-restoration operations, an image may be formed by stably ejecting liquid droplets of the ink onto the sheet 10.

In duplex printing, a first surface of the sheet 10 is printed in the above-described fashion, and a second surface (i.e., the rear surface) of the sheet 10 is printed in the following fashion. That is, when a rear end of the sheet 10 passes through an inverting part (i.e., the switching claw 81), the sheet-discharging roller 64 is driven in reverse so that the sheet 10 is switched back to be guided on the inverting guide member 82 side. The sheet 10 is then transferred into a nip between the inverting roller 83 and the spur 84, and is further transferred into a nip between the reverse transferring part 51*b* of the transfer belt 51 and the transferring-assistant roller 85.

Accordingly, the sheet 10 is attracted by the transfer belt 51, and the attracted sheet 10 is transferred by the peripheral traveling of the transfer belt 51. The sheet 10 is then separated from the transfer belt 51 on the transfer roller 52 side to be guided by the bypass guide member 86 (via a bypass). The sheet 10 is then transferred into a nip between a normal transferring part 51*a* and the presser roll 48 to be attracted by the transfer belt 51. Thereafter, the sheet 10 is transferred again into the image forming region where an image is printed on the second surface of the sheet 10 by the recording head 24, and the sheet 10 having the image printed on the second surface is discharged onto the sheet-receiving tray 7.

Figure 3:
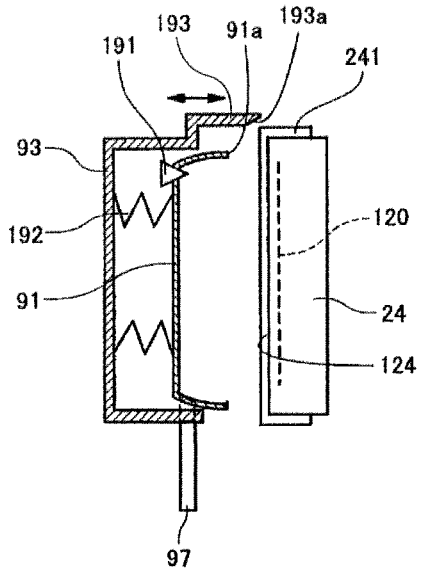
FIG. 3 is a schematic diagram illustrating a cap part of a maintenance-restoration mechanism according to a first embodiment.
Figure 4:
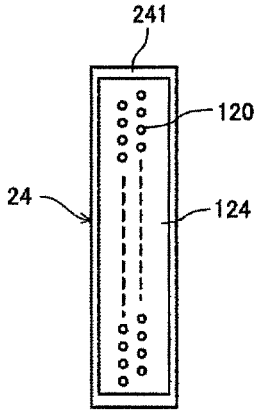
FIG. 4 is a front diagram illustrating a recording head.

Next, details of a cap part of a maintenance-restoration mechanism according to a first embodiment are described with reference to FIGS. 3 and 4. Note that FIG. 3 is a schematic diagram illustrating the cap part and FIG. 4 is a front diagram illustrating the recording head.

The recording head 24 includes a nozzle cover 241 configured to cover a peripheral part of the nozzle surface 124 and an outer peripheral surface of the recording head 24 including an upper end surface and a lower end surface of the recording head 24.

The suction cap 91 includes an air release port connected to an air-release valve 191 and configured to allow air inside the suction cap 91 to be open to the atmosphere with the suction cap 91 being in a capping state, and a suction port connected to the suction-discharge path 97 and configured to discharge a waste liquid inside the suction cap 91. Note that an air release port and a suction port are disposed on the upper side and the lower side of the suction cap 91, respectively. Note also that the air release port may either be directed in a vertical direction or in a horizontal direction.

The suction cap 91 is movably (displaceable) held by the cap holder 93 retractably disposed in a direction indicated by an arrow via a spring 192 serving as a elastic member.

The cap holder 93 includes a head guide part 193 configured to be brought into contact with the upper end surface of the recording head 24 (i.e., the upper end surface of the nozzle cover 241) so as to come into contact with the upper end surface of the recording head 24 to frictionally move on the upper end surface of the recording head 24 while the suction cap 91 is in the capping state. The suction cap 91 is located corresponding to the nozzle surface 124 by allowing the head guide part 193 to come into contact with the upper end surface of the recording head 24 to frictionally move on the upper end surface of the recording head 24.

Note that the cap holder 93 is not provided with a head guide part configured to come into contact with the lower end surface of the recording head 24 to frictionally move on the lower end surface of the recording head 24.

With this configuration, a cleaning operation is performed when a predetermined maintenance-restoration operation is required, such as when the nozzles 120 of the recording head 24 are clogged, or when a negative pressure inside the head tank 29 is not maintained to break the meniscuses of the nozzles 120. The cleaning operation includes a suction operation to suction the ink from the nozzles 120 of the recording head 24, a wiping operation to wipe the nozzle surface 124, and a non-printing liquid discharge operation to discharge or eject liquid droplets that are not used for forming an image.

Figure 5B:
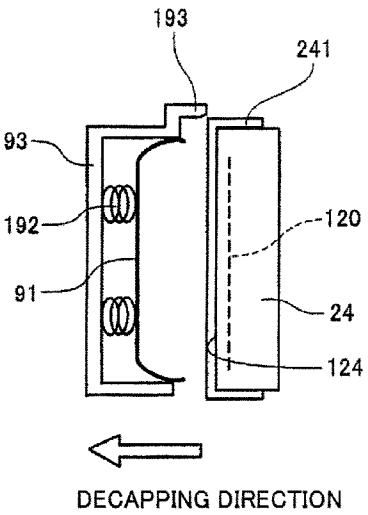
FIGS. 5A and 5B are schematic diagrams illustrating the recording head when a suction operation is conducted.

Note that the suction operation is performed in the order of capping, ink suctioning, air releasing, internal cap suctioning, and decapping. The suction operation is described with reference to FIGS. 5A and 5B.

Figure 5A:
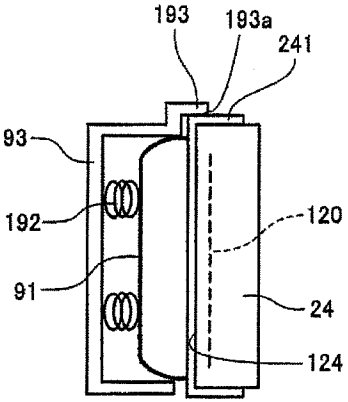

Initially, as illustrated in FIG. 5A, the head guide part 193 of the cap holder 93 comes in contact with an upper end of the recording head 24, and a capping position is restricted by causing the head guide part 193 to run on the upper end of the record head 24 along a shape of an inclined surface 193*a* of the head guide part 193.

Thereafter, a nip part of the suction cap 91 comes in contact with the nozzle surface 124, and an airtight space is formed by further pushing the nip part of the suction cap 91 against the nozzle surface 124.

In this state, after a predetermined amount of ink is suctioned from the nozzles 120 by driving the suction pump 96, the air-release valve 191 of the suction cap 91 is then opened, and ink inside the suction cap 91 is suctioned (i.e., the internal cap suctioning) by utilizing the suction pump 96 again.

Subsequently, as illustrated in FIG. 58, the cap holder 93 is moved in a decapping direction such that the suction cap 91 is separated from the nozzle surface 124 (decapping).

Then, the carriage 23 is moved to a wiping position, and a not-illustrated wiping stepping motor is rotationally driven in a normal direction so as to perform a vertical wiping operation to wipe the nozzle surface 124 with the wiper member 94 by moving the wiper member 94 in a direction from the top to the bottom of the nozzle surface 124.

Subsequently, the non-printing liquid droplet discharge operation is performed by moving the carriage 23 to a position where the recording head 24 faces a non-printing liquid droplet receiver 95. Then, the wiper member 94 is moved back to a standby position by rotationally driving the wiping stepping motor in a reverse direction while moving the carriage 23 to a non-printing liquid droplet discharge position.

In this state, the ink may be discharged into the suction cap 91 in some usage environment. Hence, the amount of ink (i.e., waste liquid) remaining inside the suction cap may be increased even if the ink inside the suction cap is suctioned. In such a case, the ink amount in a decapping condition is large, which may cause ink dripping when the suction cap 91 is decapped (i.e., the decapping condition).

In this case, since the cap holder 93 according to the embodiment is not provided with the head guide part on its lower side, ink will not adhere to the head guide part. Accordingly, accuracy in the cap position when the nozzle surface 124 is capped with the suction cap 91 (i.e., capping condition) is maintained, and suctioning performance may be prevented from lowering.

Further, since the ink interfering with the lower end surface of the recording head 24 in the vertical wiping operation is not brought into contact with the head guide part of the cap holder 93, the ink will not adhere to the head guide part. Accordingly, accuracy in the cap position when the nozzle surface 124 is capped with the suction cap 91 may be maintained, and suctioning performance may be prevented from lowering.

Details of the above condition is described with reference to a comparative example illustrated in FIG. 9A to FIG. 11C.

In this comparative example, the cap holder 93 is provided with a head guide part 393 configured to come into contact with the lower end surface of the recording head 24 to frictionally moved on the lower end surface of the recording head 24.

Figure 9B:
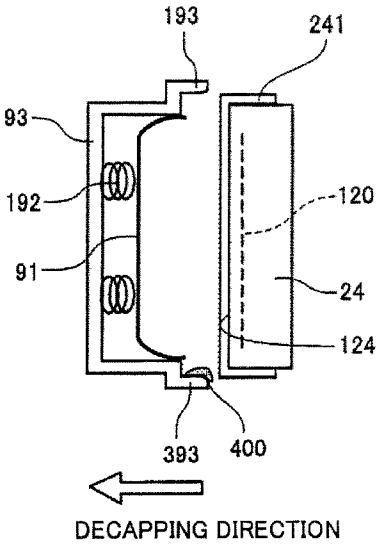
FIGS. 9A and 9B are schematic diagrams illustrating a comparative example of a recording head when a suction operation is conducted.
Figure 9A:
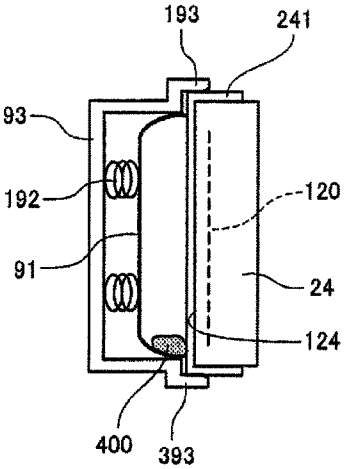

With this configuration, when a waste liquid 400 remains inside suction cap 91 after having performed the internal cap suctioning as illustrated in FIG. 9A, the remaining waste liquid 400 is dripping on the head guide part 393 when the suction cap 91 is decapped, and the dripping waste liquid adheres to the head guide part 393 as illustrated in FIG. 9B.

Figure 10A:
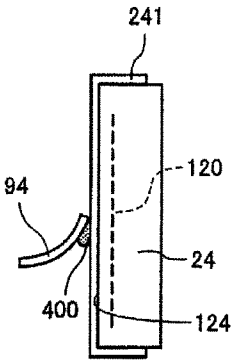
FIGS. 10A through 10C are schematic diagrams illustrating the comparative example of the recording head when a wiping operation is conducted.
Figure 10B:
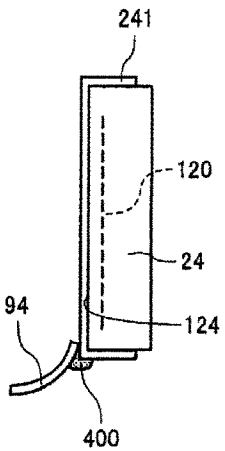
Figure 10C:
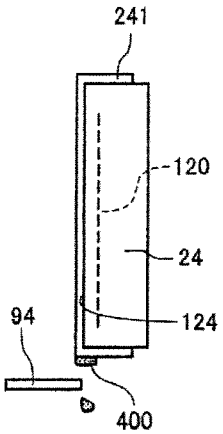

Further, in the vertical wiping operation performed with the wiping member 94 as illustrated in FIG. 10A, the waste liquid 400 may interfere with the lower end surface of the recording head 24 when the wiper member 94 is separated from the recording head 24 at a wiping end part as illustrated in FIG. 100.

Figure 11A:
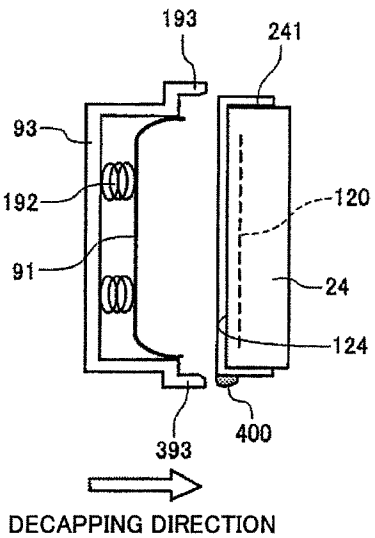
FIGS. 11A through 11C are schematic diagrams illustrating the capping operation after the wiping operation is conducted.
Figure 11B:
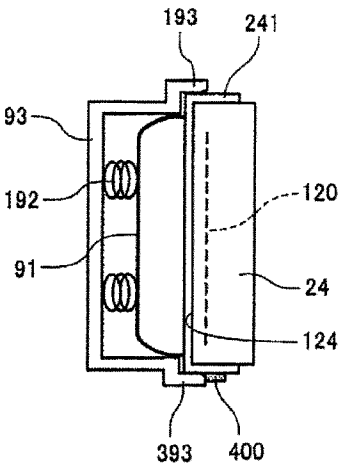
Figure 11C:
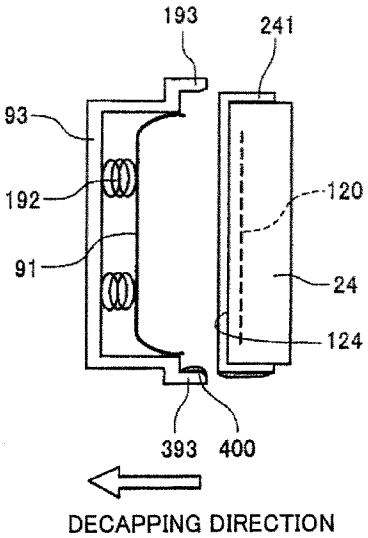

In this condition, the cap holder 93 is moved in the capping direction to cap the nozzle surface 124 of the recording head 24 with the suction cap 91 as illustrated in FIG. 11A, the waste liquid 400 remaining on the lower end surface of the recording head 24 comes in contact with a lower side of the head guide part 393 of the cap holder 93 as illustrated in FIG. 11B. Accordingly, the waste liquid 400 may be transferred onto the lower side of the head guide part 393 of the cap holder 93 when the suction cap 91 is decapped, and the transferred waste liquid 400 may adhere to the lower side of the head guide part 393 as illustrated in FIG. 11C.

Thus, when the waste liquid 400 is attached to and adheres to the lower side of the head guide part 393 of the cap holder 93, the airtight sealing condition may become incomplete by shifting a cap position from a target position. Hence, the nozzles 120 may be dried, or viscosity of the liquid ink may be increased, which may lower the suction performance conducted for restoring the nozzles 120.

Compared to the above comparative example, since the maintenance-restoration mechanism according to the first embodiment includes no lower side head guide part 393 of the cap holder 93, the above malfunction due to dryness of the nozzles or increase in viscosity does not occur.

Figure 6B:
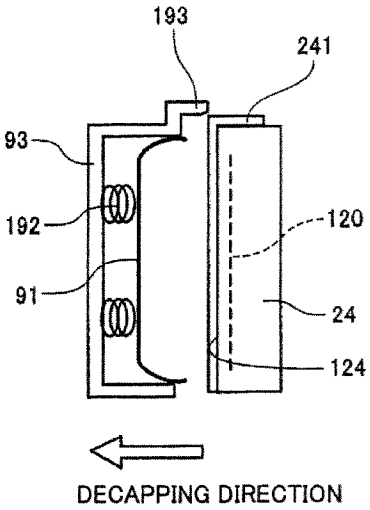
FIGS. 6A and 6B are schematic diagrams illustrating a cap part of a maintenance-restoration mechanism according to a second embodiment.
Figure 6A:
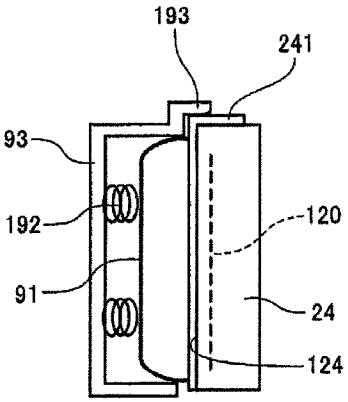

Next, a maintenance-restoration mechanism according to a second embodiment is described with reference to FIGS. 6A and 6B. FIGS. 6A and 6B are schematic diagrams illustrating a cap part of the maintenance-restoration mechanism according to the second embodiment.

In the maintenance-restoration mechanism according to the second embodiment, a nozzle cover 241 of the recording head 24 does not have a part to cover an outer circumference of the lower end surface of the recording head 24. That is, the nozzle cover 241 does not have a bending part bent along the lower side of the recording head 24, such that a lower end of the nozzle cover 241 has an edge shape.

With such a configuration, a waste liquid does not interfere with the lower end surface of the recording head 24 when the vertical wiping operation is performed. In addition, since the cap holder 93 does not have a lower side of the head guide part, the waste liquid will not be transferred to the lower side of the head guide part.

Accordingly, accuracy in the cap position when the nozzle surface 124 is capped with the suction cap 91 may be maintained, which may be able to not only prevent the suction performance from lowering but also prevent the waste liquid from adhering to the lower end surface of the recording head 24, which may prevent the internal parts of the image forming apparatus from becoming contaminated.

Figure 7B:
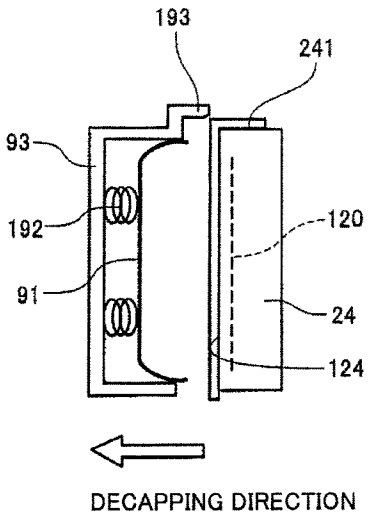
FIGS. 7A and 7B are schematic diagrams illustrating another example of the cap part of the maintenance-restoration mechanism according to the second embodiment.
Figure 7A:
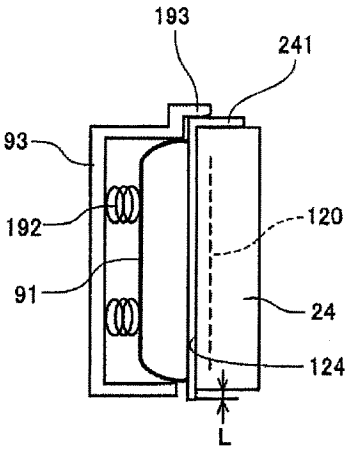

In this case, it is preferable that the lower end of the nozzle cover 241 be downwardly projected from the lower end surface of the recording head 24 (see a projected amount indicated with "L" in FIG. 7A in this example) because the nozzle cover 241 having the above configuration may securely prevent the waste liquid from interfering with the lower end surface of the recording head 24, as illustrated in FIGS. 7A and 7B.

Figure 8:
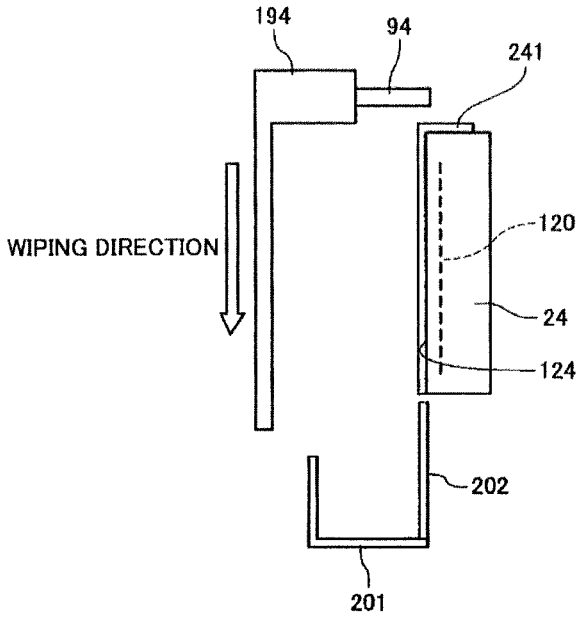
FIG. 8 is a schematic diagram the maintenance-restoration mechanism according to a third embodiment.

Next, a maintenance-restoration mechanism according to a third embodiment is described with reference to FIG. 8. FIG. 8 is a schematic diagram the maintenance-restoration mechanism according to a third embodiment.

In the maintenance-restoration mechanism according to the third embodiment, an ink receiver 201 serving as a liquid receiving member configured to receive a liquid dripping from the recording head 24 or the suction cap 91 (i.e., the waste liquid) is disposed on a bottom surface inside the image forming apparatus. The ink receiver 201 is disposed such that a position of the ink receiver 201 is aligned with a position of the recording head 24 when the suction cap 91 is decapped.

That is, there may be a large amount of the waste liquid (ink) remaining inside the suction cap 91 in some usage environment, and ink dripping may be observed when the suction cap 91 is decapped. In such a condition, since the head guide part is not disposed on the lower side of the cap holder 93 as mentioned earlier, a dripping waste liquid may adhere to the nozzle surface 124 or fall onto the bottom inner part of the image forming apparatus.

Accordingly, the liquid dripping from the recording head 25 or the suction cap 91 (i.e., the waste liquid) is received by the ink receiver 201, thereby preventing the waste liquid from contaminating the inside of the image forming apparatus.

Note that the ink receiver 201 is disposed on the maintenance-restoration mechanism 9 side. For example, the ink receiver 201 may be fixed on a frame 101L (see FIG. 2) with screws or the like.

Further, the maintenance-restoration mechanism according to the third embodiment further includes an ink receiver surface 202 serving as a liquid receiver surface configured to receive liquid droplets scattered in a rearward direction when the wiper member 94 is detached from the recording head 24 at the end of wiping operation. The ink receiver surface 202 is disposed below the recording head 24 in parallel with the nozzle surface 124 when the nozzle surface 124 is directed to its front side.

That is, in performing the vertical wiping operation, the waste liquid wiped with the wiper member 94 may be blown off in a direction below and behind the recording head 24 immediately after having the lower end of the nozzle cover 241 wiped with the wiper member 94.

Thus, the waste liquid may be prevented from adhering to the carriage 23, and the waste liquid may be prevented from being transferred from the carriage 23 to the sheet 10 by allowing the ink receiver surface 202 to receive the waste liquid being blown off (scattered).

In this case, the number of components may be reduced by integrally forming the ink receiver 201 and the ink receiver surface 202.

Note that in the present application, a material of the "sheet" is not limited to paper, but may include an overhead projector (OHP) film, cloth, glass, and a substrate, to which ink droplets or other liquids are attachable. Examples of the materials for the sheets may be called a "recording medium subject to being recorded on", a "recording medium", "recording paper", and a "recording sheet". Further, the terms "image forming", "recording", "printing", and "copying" may be used as synonyms.

In addition, the term an "image forming apparatus" indicates an apparatus that forms an image onto media such as paper, string, fiber, fabric, leather, metal, plastic, glass, wood, and ceramics by discharging liquid onto such media. Moreover, the term "forming an image" or "image formation" not only indicates providing an image having some kind of meaning onto the media such as characters and symbols, but also indicates an image without having any meaning such as patterns (i.e., by simply discharging ink droplets onto the media).

Further, the term "ink" is not specifically limited to those generally called "ink", but may used as a generically called "liquid" capable of forming an image, such as a recording liquid, a fixing liquid, and a liquid. The term "ink" further includes DNA specimens, resist, a patterning material, resin, and the like.

Moreover, the "image" is not limited a two-dimensional image, but may include an image applied to a three-dimensionally formed object, and to a three-dimensional image formed of a molded object.

Further, in the illustration of the maintenance-restoration mechanism according to the above embodiments, the sheet is transferred in a direction along the vertical direction (perpendicular direction), and the liquid droplets are ejected in the horizontal direction. However, the maintenance-restoration mechanism may be configured such that the sheet is transferred in a direction inclined to the vertical direction (perpendicular direction), and the liquid droplets is ejected in a direction inclined to the horizontal direction.

In the image forming apparatus according to the above embodiments having the recording head with the nozzle surface being disposed in the vertical direction, the remaining waste liquid may be prevented from adhering to the cap holder.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

This patent application is based on Japanese Priority Patent Application No. 2012-006229 filed on Jan. 16, 2012, the entire contents of which are hereby incorporated herein by reference.

What is claimed is:

1. An image forming apparatus comprising:

a recording head having a nozzle surface including a plurality of nozzles configured to eject liquid droplets;

a suction cap configured to seal the nozzle surface of the recording head;

a cap holder configured to displaceably hold the suction cap via an elastic member and retractably disposed corresponding to the recording head; and a wiping member configured to wipe the nozzle surface of the recording head in a direction from an upper side to a lower side, wherein the cap holder includes a guide part disposed on an upper end of the cap holder to come into contact with a side surface of an upper end of the recording head to frictionally move on the side surface of the upper end of the recording head together with the cap holder, the guide part is a plate-like member that projects from the upper end of the cap holder in a direction parallel to a liquid ejecting direction of the nozzles, and the guide part is disposed on an upper end side of the cap holder and not disposed on a lower end side of the cap holder.

2. The image forming apparatus as claimed in claim 1, wherein the recording head includes a nozzle cover configured to cover a peripheral part of the nozzle surface and an outer peripheral surface of the recording head, and the nozzle cover covers an upper part of the outer peripheral surface and side surfaces of the outer peripheral surface, and does not cover a lower part of the outer peripheral surface of the recording head.

3. The image forming apparatus as claimed in claim 2, wherein the nozzle cover is downwardly projected from the lower end surface of the recording head.

4. The image forming apparatus as claimed in claim 1, further comprising:

a liquid receiving member disposed below the recording head and configured to receive a liquid dripping from the suction cap side and the recording head side.

5. The image forming apparatus as claimed in claim 1, further comprising:

a liquid receiving surface disposed below the recording head in parallel with the nozzle surface and configured to receive a liquid scattered by causing the wiping member to complete a wiping operation.

6. The image forming apparatus as claimed in claim 1, further comprising:

an integral member formed of a liquid receiving member and a liquid receiving surface, the liquid receiving member being disposed below the recording head and configured to receive a liquid dripping from the suction cap side and the recording head side, the liquid receiving surface being disposed below the recording head in parallel with the nozzle surface and configured to receive a liquid scattered by causing the wiping member to complete a wiping operation.

* * * * *